United States Patent [19]

Salkeld

[11] Patent Number: 4,721,270

[45] Date of Patent: Jan. 26, 1988

[54] MISSILE GUIDANCE SYSTEMS

[75] Inventor: David Salkeld, Stevenage, United Kingdom

[73] Assignee: British Aerospace plc, London, England

[21] Appl. No.: 925,256

[22] Filed: Oct. 31, 1986

[30] Foreign Application Priority Data

Oct. 31, 1985 [GB] United Kingdom ..... 8526850

[51] Int. Cl.[4] ..... F41G 7/30

[52] U.S. Cl. ..... 244/3.11

[58] Field of Search ..... 244/3.11, 3.14

[56] References Cited

U.S. PATENT DOCUMENTS 3,098,933 7/1963 Barasch ..... 244/3.14

4,274,609 6/1981 Ferrier et al. ..... 244/3.14

4,397,429 8/1983 Fouilloy ..... 244/3.11

*Primary Examiner*—Charles T. Jordan

*Attorney, Agent, or Firm*—Cushman, Darby & Cushman

[57] ABSTRACT

In automatic command to line of sight guidance systems, the missile and target are tracked remotely and a guidance computer processes the tracking data to provide a guidance command for the missile. In such systems, the target and missile must be visible but when the angular subtense of the missile flare is greater than that of the target, the target is totally obscured by the flare when the missile is on sightline leading to the erroneous guidance commands. Described herein is a system in which the obscuration of the target by the missile flare is reduced by guiding the missile along a trajectory displaced from the sightline until the target subtense is the same size as that of the missile.

3 Claims, 2 Drawing Figures

MISSILE GUIDANCE SYSTEMS

Figure 1:
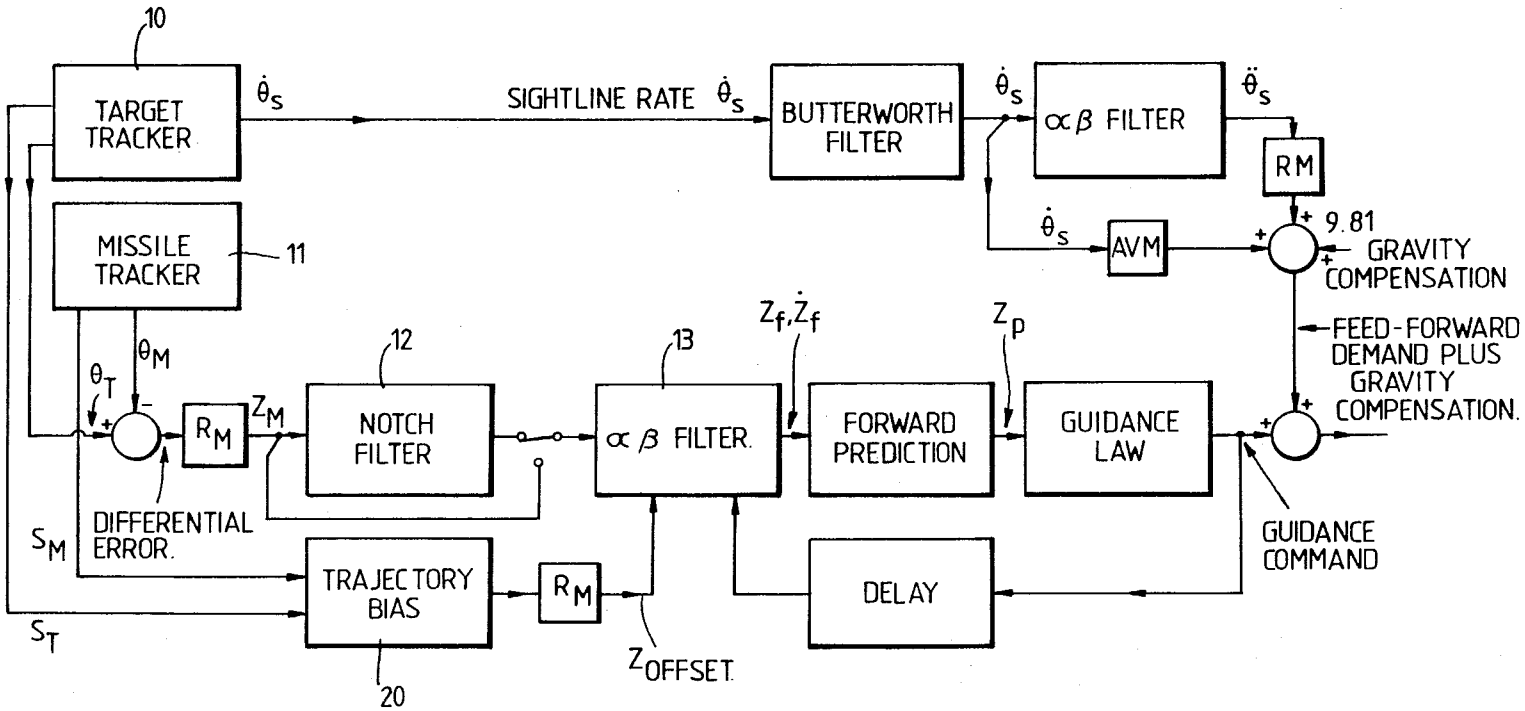

This invention relates to missile guidance systems in which the missile and its intended target are tracked from a remote tracking location.

In a form of guidance known as "Automatic command to line of sight" (ACLOS) the missile and the target are each tracked by trackers located at a tracking location and a guidance computer processes data from the trackers to determine and transmit to the missile a guidance command to maintain the missile on a line connecting the tracker location and the target; this line is referred to as the sightline. In such automatic systems it is important to ensure that both the target and the missile are visible to allow tracking and calculation of guidance commands. However, when the angular subtense of the missile flare is greater than the angular subtense of the target, the target will be totally obscured by the flare when the missile is on the sightline. Even if the guidance computer successfully coasts through a period when the target is obscured by the flare, it is thought highly unlikely that the target tracker will be able to regain good tracking until a substantial proportion of the target is uncovered. In practice, an absence of target data will almost always lead to erroneous guidance signals being passed to the missile which will move it away from the sightline. Initially this will expose one side of the target; if the tracker locks to the exposed part it will result in guidance commands tending to reverse the initial motion of the missile so exposing the opposite side of the target and providing a type of "dither" in the guidance loop and this may jeopardise the chances of achieving a good trajectory particularly where the period for which the target is consistently visible is short.

It is therefore an aim of this invention to provide a guidance system in which obscuration of the target by the missile is reduced. It is a further aim of this invention to provide such a system in which a reduction in obscuration is achieved without the need to determine the range of the target.

According to one aspect of this invention, there is provided a missile guidance system including missile tracker means for outputting missile directional data representative of the angular direction of said missile and missile subtense data representative of the angular subtense of said missile, target tracker means for outputting target directional data representative of the angular direction of said target and target subtense data representative of the angular subtense of said target, processing means for processing said missile directional data and target directional data to generate a guidance command adapted to maintain said missile on a sightline connecting the target and the tracker, comparator means for comparing said missile subtense data and said target subtense data, and trajectory bias means responsive to the output of said comparator means for applying an offset to said guidance command when the ratio of the missile subtense to the target subtense exceeds a predetermined value.

By this arrangement, when the predetermined ratio is exceeded, the missile is guided along a trajectory displaced relative to the sightline until at least the target subtense is the same size as that of the missile. The offset applied is preferably such as to cause the missile to follow a trajectory displaced relative to the sightline by a predetermined angular amount. The angular amount will be predetermined and set on the basis of factors such as missile flare size and intensity, expected size and range of the target, atmospheric conditions, etc.

Figure 2:
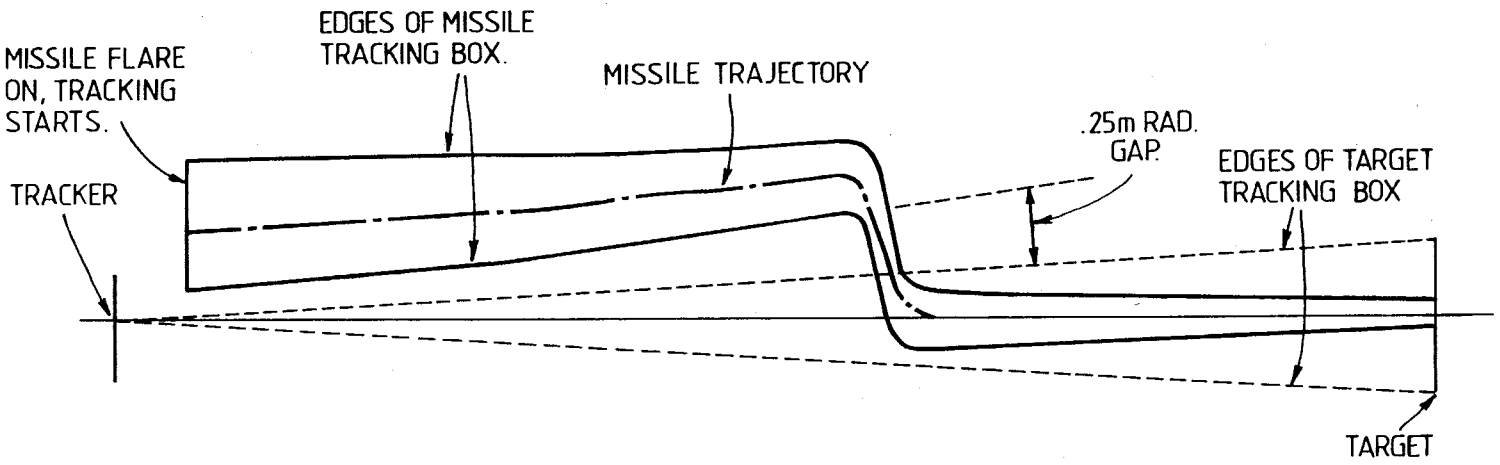

By way of example only, one specific arrangement of missile guidance system will now be described in detail, reference being made to the accompanying drawings in which:

FIG. 1 is a schematic block diagram illustrating the guidance algorithm, and FIG. 2 is a schematic illustration of the elevation plane of the trajectory of a missile relative to the sightline during an engagement.

The missile guidance system to be described is for use with a missile which is intended to travel at high speeds and to inflict damage on a target primarily by virtue of the transfer of kinetic energy from the missile to the target on impact. It is clear therefore that the high speed and the accuracy necessary for a direct hit rather than a proximity pass lead to a requirement for precise guidance.

Referring now to FIG. 1, the system includes an electro-optic target tracker 10 for tracking a target via a charge-coupled device (CCD) camera (not shown) and a missile tracker 11 of similar form for tracking the pyrotechnic flare provided on the tail portion of the missile. The target and missile trackers output date representing the boresight error of the target ($\theta_T$) and the missile ($\theta_M$) respectively together with data representing the size of the target image ($s_T$) and the size of the missile image ($S_M$). It will be appreciated that the size of the tracked image is proportional to the angular subtense of the image, that is the angle subtended by the diameter (or equivalent) of the image. The data $S_M$, $S_T$ may represent the actual image size sensed by the camera or, more preferably, it may represent the size of the tracking gate of the target or missile as the case may be. The tracking gate is defined as that area of the image plane which is analysed by the tracker and is of course representative of the size of the tracked object. It is believed that the derivation of suitable data from the trackers is within the competence of one skilled in the art.

The boresight error of the target $\theta_T$ is subtracted from that of the missile $\theta_M$ to obtain a differential error; the differential error is then multiplied by the range $R_M$ of the missile to determine a measured miss distance $Z_M$. The range of the missile is preferably obtained from missile range a look up table which relates time of flight of the missile to its range. The measurements of miss distance $Z_M$ are filtered at a notch filter 12 to remove any oscillatory motion due to the response of the missile airframe.

Estimates of the miss distance and miss distance rate $Z_f$, $\dot{Z}_f$ are derived using an alpha-beta filter 13 applied to the measurements, and a forward prediction of miss distance $Z_p$ is calculated to overcome some of the effects of time delays in the system. The resultant values of miss distance and rate are processed using a proportional plus differential guidance law to determine the lateral acceleration (latax) demand to reduce miss distance. This feed forward latax demand is calculated which allows for target sightline rate $\dot{\theta}_s$ and acceleration $\ddot{\theta}_s$ is calculated and combined with that of the guidance law and that for gravitational acceleration. The resultant latax demand is then passed to the missile for implementation.

The system as described thus far implements a guidance algorithm designed to maintain the target on the sightline connecting the target tracker with the target. However, the subtense of the missile flare will initially be greater than that of the target, and the equality point, i.e. the point at which the subtense of the missile flare is of equal value to that of the target, will be reached only after the missile has travelled some distance. The equality point will of course depend on many factors, for example the flare diameter and brightness, the size and range of the target, atmospheric conditions, etc., but in typical applications the equality point may be reached only when the missile is half way to its target and taking into account the fact that the missile accelerates from rest to its cruise speed, this means that the target may be obscured by the missile flare for well over half the flight period of the missile. In some instances, this may lead to there being insufficient time between the equality point and the potential intercept point for the guidance computer to establish a good trajectory.

The guidance algorithm has been modified to introduce a trajectory bias so that when the ratio of the size of the missile tracking gate to the size of the target tracking gate exceeds a predetermined value (for example unity or a set value greater than unity) the missile follows a trajectory which is angularly displaced from the sightline (see FIG. 2). In the example illustrated, the angular displacement is 0.25 m Radians, though the size of the displacement will depend on the parameters of the system such as missile flare size and intensity, expected target size, etc.

The missile size date $S_M$ and the target size data $S_T$ are supplied to a trajectory bias controller 20 which compares the data to determine whether the ratio of the missile subtense to the target subtense exceeds the preset threshold value. If the ratio is exceeded, the trajectory bias controller 20 outputs the angular bias of 0.25 m Radians which is then multiplied by the missile range $R_M$, which is obtained from the missile range look up table, to derive an azimuth offset value $Z_{offset}$ which is fed in to the alpha-beta filter 13 to provide an azimuthal angular offset to the missile trajectory.

The offset may be upwards, downwards, or to either side of the target, but it is preferred for the offset to be upwards. The missile therefore is temporarily guided on to a point spaced upwards from the target until the missile/target subtense ratio falls below the preset threshold value. During this initial period the target is not obscured by the missile flare and thus good tracking of the target is possible. Once the ratio falls below the threshold value, the missile is brought quickly down onto the sightline in good time before impact. The system thus allows tracking of the target for almost all of the engagement time. It is important to note that the $Z_{offset}$ value should be applied to the miss distance $Z_M$ after the notch filter since when the ratio passes the threshold value, the trajectory bias controller 20 effectively imposes a step onto the miss distance waveform and this would cause stability problems if introduced before the notch filter.

I claim:

1. A missile guidance system including missile tracker means for outputting missile directional data representative of the angular direction of said missile and missile subtense data representative of the angular subtense of said missile, target tracker means for outputting target directional data representative of the angular direction of said target and target subtense data representative of the angular subtense of said target, processing means for processing said missile directional data and target directional data to generate a guidance command adapted to maintain said missile on a sightline connecting the target and the tracker, comparator means for comparing said missile subtense data and said target subtense data, and trajectory bias means responsive to the output of said comparator means for applying an offset to said guidance command when the ratio of the missile subtense to the target subtense exceeds a predetermined value.

2. A system according to claim 1, wherein the missile is guided along a trajectory displaced relative to the sightline until the target subtense is the same size as that of the missile when said predetermined value is exceeded.

3. A system according to claim 2, wherein the offset applied causes the missile to follow a trajectory displaced relative to the sightline by a predetermined angular amount.

* * * * *